US005737856A

United States Patent [19]

Brockman

[11] Patent Number: 5,737,856

[45] Date of Patent: Apr. 14, 1998

[54] REMOVABLE AND REPLACEABLE CLEAT APPARATUS FOR FOOTWEAR

[76] Inventor: Raymond J. Brockman, P.O. Box 168, Holbrook, N.Y. 11741

[21] Appl. No.: 734,102

[22] Filed: Oct. 21, 1996

[51] Int. Cl.[6] ..... A43C 15/00

[52] U.S. Cl. ..... 36/62; 36/67 D

[58] Field of Search ..... 36/59 R, 132, 36/67 D, 62, 61

[56] References Cited

U.S. PATENT DOCUMENTS

| | | | |
|---|---|---|---|
| 1,024,981 | 4/1912 | Findlay . | |
| 1,326,687 | 12/1919 | Perry | 36/62 |
| 1,429,259 | 9/1922 | Tagliaferry | 36/62 |
| 2,166,958 | 7/1939 | Lawson . | |
| 2,425,939 | 8/1947 | Howard | 36/62 |
| 2,437,143 | 3/1948 | With | 36/62 |
| 3,914,882 | 10/1975 | Greer | 36/62 |
| 4,702,021 | 10/1987 | Cameron | 36/62 |
| 5,485,687 | 1/1996 | Rohde | 36/62 |
| 5,499,458 | 3/1996 | Krunic | 36/62 X |
| 5,533,277 | 7/1996 | Bell et al. | 36/62 X |

FOREIGN PATENT DOCUMENTS

| | | | |
|---|---|---|---|
| 2039611 | 10/1992 | Canada | 36/62 |
| 816363 | 8/1951 | Germany | 36/62 |

*Primary Examiner*—B. Dayoan

[57] ABSTRACT

A cleat apparatus includes a longitudinally elastic base assembly, a plurality of cleat units connected to the base assembly, a first strap connected to a first side of the base assembly, and a second strap connected to a second side of the base assembly. The first strap and the second strap are longitudinally elastic. The base assembly, the first strap, and the second strap are comprised of a single, unified, combination, longitudinally elastic base/strap assembly. Each of the cleat units includes a cleat support. A plurality of individual cleats project upward from the cleat support and through the base assembly. Cleat locks are connected to the cleats distal to the cleat support, whereby the cleat locks secure the cleats to the base assembly. The first strap includes a quantity of first hook-or-loop material, and the second strap includes a quantity of complementary second loop-or-hook material. In a second embodiment, the first strap is comprised of a pair of independent half-width first strap portions connected to the base assembly. Each half-width first strap portion includes a quantity of the first hook-or-loop material. The second strap is comprised of a pair of independent half-width second strap portions connected to the base assembly. Each half-width second strap portion includes a quantity of the second loop-or-hook material.

11 Claims, 3 Drawing Sheets

FIG 1
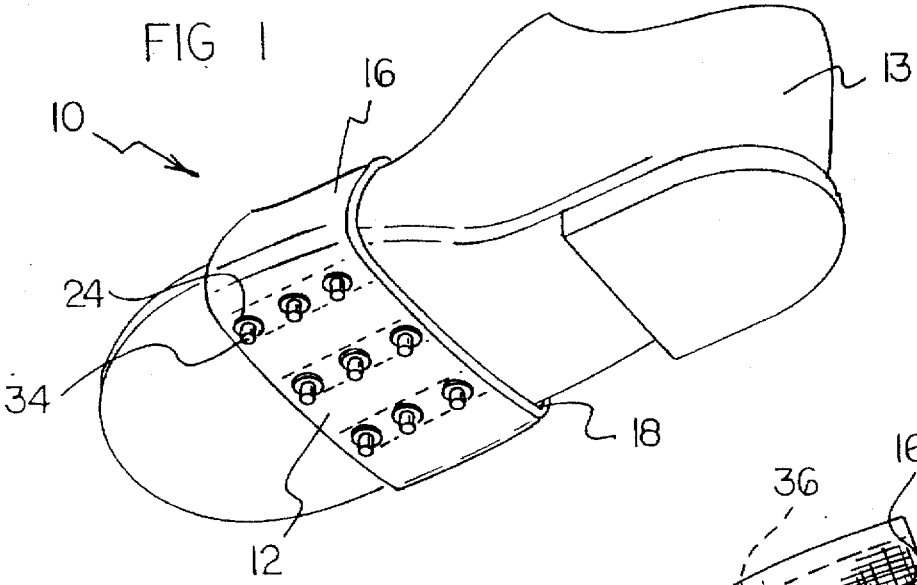
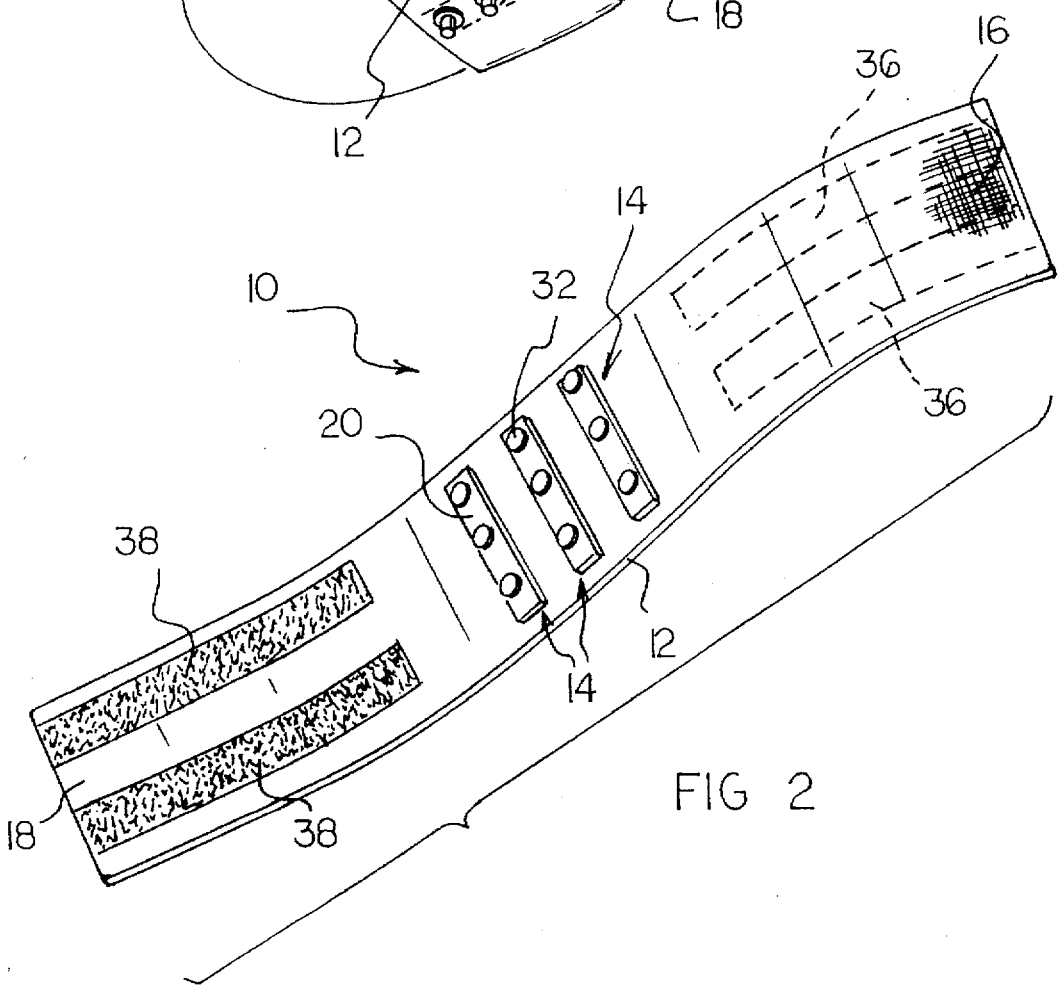
FIG 2

FIG 5
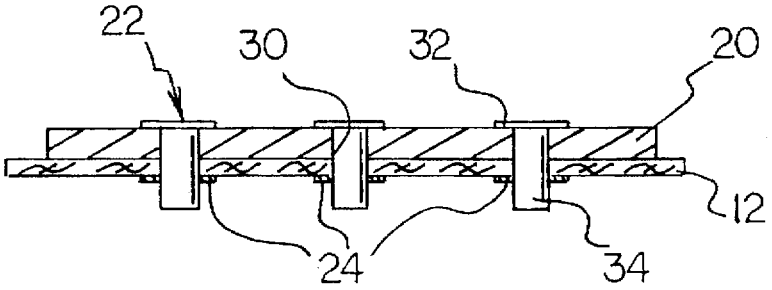
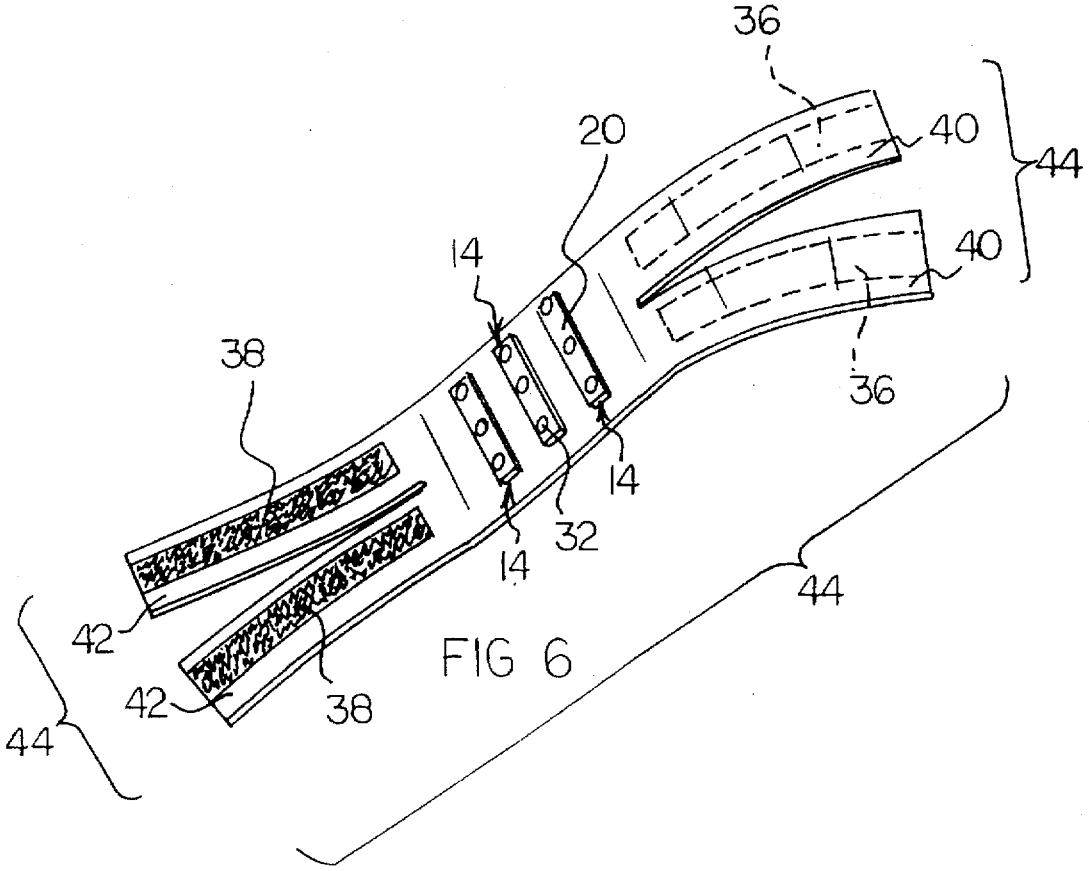
FIG 6

REMOVABLE AND REPLACEABLE CLEAT APPARATUS FOR FOOTWEAR

BACKGROUND OF THE INVENTION

1. Field of the Invention

The present invention relates generally to devices that are used to increase frictional qualities of the soles of footwear, and, more particularly, to devices especially adapted for easy attachment to and removal from the footwear.

2. Description of the Prior Art

With footwear, a problem is often encountered with respect to the frictional forces between the soles of the footwear and a surface which is tread upon. One solution is to provide footwear that has sets of cleats permanently fixed to the sole of the footwear. With this type of cleated footwear, the cleats may do damage to certain surfaces, such as wooden floors or carpets. Therefore, a second pair of footwear is needed to tread upon such damage-prone surfaces. To avoid the cost and inconvenience of using footwear that has cleats permanently fixed to the sole of the footwear, it would be desirable if removable and replaceable cleats could be added to or removed from existing footwear as desired.

Throughout the years, a number of innovations have been developed relating to removable and replaceable devices that can be used to increase the frictional properties of the soles of footwear, and the following U. S. patent are representative of some of those innovations: U.S. Pat. Nos. 1,024,981, 2,116,958, 2,425,939, 3,914,882, 4,702,021, and 5,485,687. More specifically, each of U.S. Pat. Nos. 1,024,981, 2,116,958, 2,425,939, 3,914,882, and 5,485,687 discloses a device that has a plurality of cleats that are fixed to a common base in a predetermined cleat pattern. However, there may be circumstances when it would desirable for a person to be able to alter the cleat pattern if desired. In this respect, it would be desirable if a removable and replaceable device were provided for footwear which enables a person to alter a cleat pattern if desired.

U.S. Pat. No. 4,702,021 may be of interest for its disclosure of a removable and replaceable friction increasing device for footwear that employs a fibrous material for increasing the friction between the device and a surface tread upon.

Still other features would be desirable in a removable and replaceable cleat apparatus. For example, it would be desireable if a removable and replaceable cleat apparatus were adjustable to fit a wide range of footwear sizes. Also, for ease of attachment to and detachment from footwear, it would be desirable if a removable and replaceable device were provided for footwear which employs straps that have complementary hook-and-loop material. In addition, for purposes of simplicity of manufacture, it would be desirable if a removable and replaceable device for footwear were provided which includes a single piece of material that serves to support both cleats and hook-and-loop material used to attach the device to the footwear. Also, to take up a minimum amount of space when not in use, it would be desirable if a removable and replaceable device were provided for footwear which can be folded or rolled up into a relatively small-volume form when the device is not in use.

Thus, while the foregoing body of prior art indicates it to be well known to use removable and replaceable cleat devices for footwear, the prior art described above does not teach or suggest a removable and replaceable cleat apparatus which has the following combination of desirable features:

(1) provides removable and replaceable cleats which can be added to or removed from existing footwear as desired; (2) enables a person to alter a cleat pattern if desired; (3) is adjustable to fit a wide range of footwear sizes; (4) employs straps that have complementary hook-and-loop material; (5) includes a single piece of material that serves to support both cleats and hook-and-loop material used to attach the device to the footwear; and (6) can be folded or rolled up into a relatively small-volume form when the device is not in use. The foregoing desired characteristics are provided by the unique removable and replaceable cleat apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a cleat apparatus which includes a longitudinally elastic base assembly, a plurality of cleat units connected to the base assembly, a first strap connected to a first side of the base assembly, and a second strap connected to a second side of the base assembly. The first strap and the second strap are longitudinally elastic. The base assembly, the first strap, and the second strap are comprised of a single, unified, combination, longitudinally elastic base/strap assembly.

Each of the cleat units includes a cleat support. A plurality of individual cleats project upward from the cleat support and through the base assembly. Cleat locks are connected to the cleats distal to the cleat support, whereby the cleat locks secure the cleats to the base assembly. Each cleat support is a metal block that has receiving channels for the cleats. Each cleat can be a rivet that includes a rivet head and a rivet shank connected to the rivet head. In this case, each rivet shank passes through one of the receiving channels and passes through a portion of the base assembly. Each of the cleat locks can be in a form of a washer that is fixed to a rivet shank.

The first strap includes a quantity of first hook-or-loop material, and the second strap includes a quantity of complementary second loop-or-hook material. The first strap is comprised of a pair of independent half-width first strap portions connected to the base assembly. Each half-width first strap portion includes a quantity of the first hook-or-loop material. The second strap is comprised of a pair of independent half-width second strap portions connected to the base assembly. Each half-width second strap portion includes a quantity of the second loop-or-hook material. The base assembly, the half-width first strap portions of the first strap, and the half-width second strap portions of the second strap are comprised of a single, unified, combination, longitudinally elastic base/strap assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved removable and replaceable cleat apparatus which has all of the advantages of the prior art and none of the disadvantages.

It is another object of the present invention to provide a new and improved removable and replaceable cleat apparatus which may be easily and efficiently manufactured and marketed.

It is a further object of the present invention to provide a new and improved removable and replaceable cleat apparatus which is of durable and reliable construction.

An even further object of the present invention is to provide a new and improved removable and replaceable cleat apparatus which is susceptible of a low cost of manufacture with regard to both materials and labor, and which accordingly is then susceptible of low prices of sale to the consuming public, thereby making such removable and replaceable cleat apparatus available to the buying public.

Still yet a further object of the present invention is to provide a new and improved removable and replaceable cleat apparatus which provides removable and replaceable cleats which can be added to or removed from existing footwear as desired.

Still another object of the present invention is to provide a new and improved removable and replaceable cleat apparatus that enables a person to alter a cleat pattern if desired.

Yet another object of the present invention is to provide a new and improved removable and replaceable cleat apparatus which is adjustable to fit a wide range of footwear sizes.

Even another object of the present invention is to provide a new and improved removable and replaceable cleat apparatus that employs straps that have complementary hook-and-loop material.

Still a further object of the present invention is to provide a new and improved removable and replaceable cleat apparatus which includes a single piece of material that serves to support both cleats and hook-and-loop material used to attach the device to the footwear.

Yet another object of the present invention is to provide a new and improved removable and replaceable cleat apparatus that can be folded or rolled up into a relatively small-volume form when the device is not in use.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the removable and replaceable cleat apparatus of the invention attached to a shoe.

FIG. 2 is an enlarged perspective view of the top side of the embodiment of the invention shown in FIG. 1 removed from the shoe and in an open condition.

FIG. 5 is an enlarged cross-sectional view of the embodiment of the invention shown in FIG. 4 taken along line 5—5 of FIG. 4.

FIG. 6 is a top perspective view of a second embodiment of the invention.

DESCRIPTION OF THE PREFERRED EMBODIMENT

Figure 3:
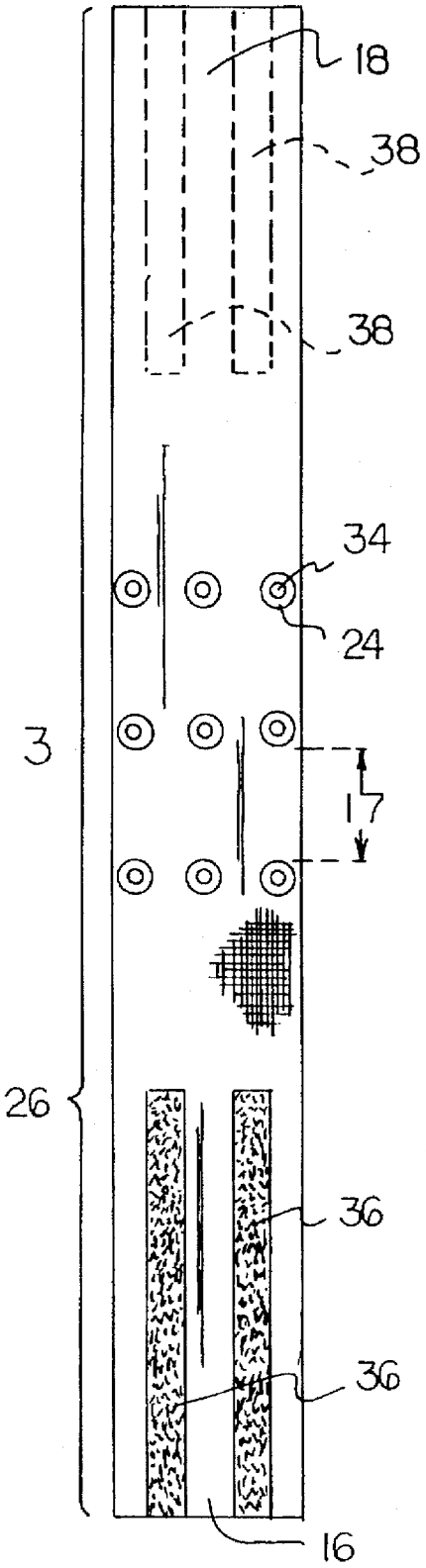
FIG. 3 is a bottom view of the embodiment of the removable and replaceable cleat apparatus of FIG. 2 in a stretched condition.

With reference to the drawings, a new and improved removable and replaceable cleat apparatus embodying the principles and concepts of the present invention will be described.

Turning to FIGS. 1–5, a first embodiment of the removable and replaceable cleat apparatus of the invention is shown and is generally designated by reference numeral 10. In the first embodiment, the removable and replaceable cleat apparatus 10 includes a longitudinally elastic base assembly 12, a plurality of cleat units 14 connected to the base assembly 12, a first strap 16 connected to a first side of the base assembly 12, and a second strap 18 connected to a second side of the base assembly 12. The cleat apparatus 10 is attached to a shoe 13. The first strap 16 and the second strap 18 are longitudinally elastic. The base assembly 12, the first strap 16, and the second strap 18 are comprised of a single, unified, combination, longitudinally elastic base/strap assembly 26.

Each of the cleat units 14 includes a cleat support 20. A plurality of individual cleats 22 project upward from the cleat support 20 and through the base assembly 12. Cleat locks 24 are connected to the cleats 22 distal to the cleat support 20, whereby the cleat locks 24 secure the cleats 22 to the base assembly 12. Each cleat support 20 is a metal block that has receiving channels 30 for the cleats 22. Each cleat 22 can be a rivet that includes a rivet head 32 and a rivet shank 34 connected to the rivet head 32. In this case, each rivet shank 34 passes through one of the receiving channels 30 and passes through a portion of the base assembly 12. Each of the cleat locks 24 can be in a form of a washer 24 that is fixed to a rivet shank 34.

The first strap 16 includes a quantity of first hook-or-loop material 36, and the second strap 18 includes a quantity of complementary second loop-or-hook material 38. The first hook-or-loop material 36 and the second loop-or-hook material 38 can be made from the well known VELCO(TM) material. The first hook-or-loop material 36 and the second loop-or-hook material 38 can be made from material that is substantially longitudinally inelastic. Where longitudinally inelastic first hook-or-loop material 36 is connected to the first strap 16 and where longitudinally inelastic second loop-or-hook material 38 is connected to the second strap 18, the first strap 16 and the second strap 18 are substantially longitudinally inelastic.

In using the first embodiment of the invention, the top of the base assembly 12 is placed against the bottom of the sole of the shoe 13 as shown in FIG. 1. As shown in the figures, the first hook-or-loop material 36 faces down from the bottom side of the first strap 16, and the second loop-or-hook material 38 faces up from the top side of the second strap 18. The first strap 16 is grasped by a person in one hand, and The first strap 18 is grasped by the person in the other hand. The first strap 16 and the second strap 18 are pulled sufficiently tight, and the second strap 18 is positioned to overlap the first strap 16. With this arrangement, when the second loop-or-hook material 38 overlaps with the first hook-or-loop material 36, they are pressed together and the cleat apparatus 10 of the invention stays securely fit on the shoe 13.

Figure 4:
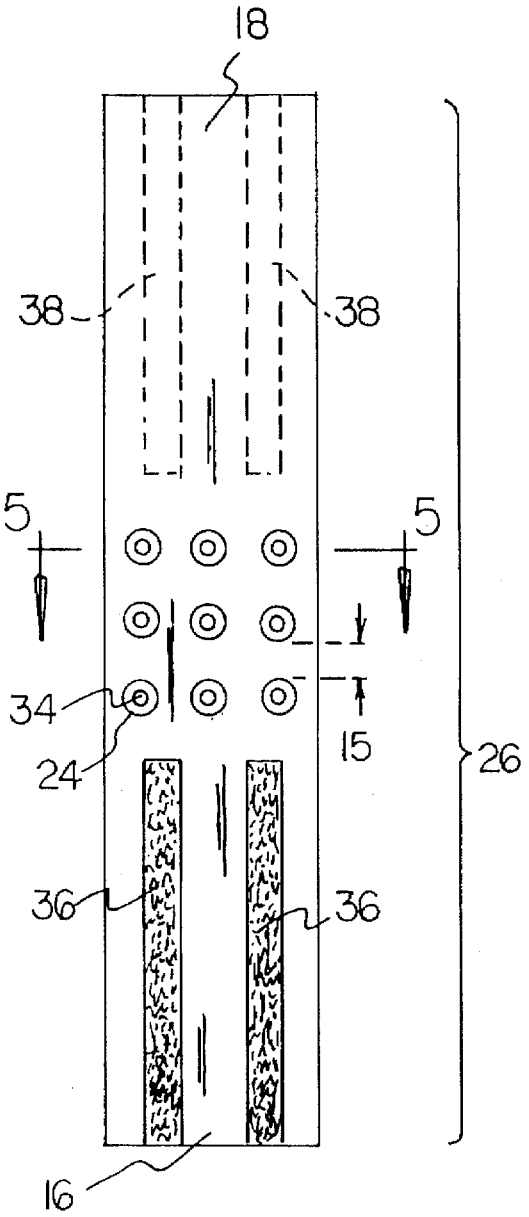
FIG. 4 is a bottom view of the embodiment of the invention shown in FIG. 3 in a relaxed condition.

As shown in FIG. 4, the longitudinally elastic portions of the cleat apparatus 10 are in a relaxed condition. In this condition, the distance between adjacent cleat units 14 is a relatively small relaxed separation distance 15. In contrast, as shown in FIG. 3, when the longitudinally elastic portions of the cleat apparatus 10 are in a stretched condition, there is a larger stretched separation distance 17. It is clear, then, with the cleat apparatus 10 of the invention, the separation distance between adjacent cleat units 14 can be varied by varying the degree of stretch in the longitudinally elastic base assembly 12 of the cleat apparatus 10.

The ability to adjust the degree of stretch of the longitudinally elastic portions of the cleat apparatus 10 also permits the cleat apparatus 10 to be adjusted and employed with a wide variety of footwear sizes.

Because the longitudinally elastic base/strap assembly 26 is flexible, the cleat apparatus 10 can readily be folded up or rolled up into a relatively small volume for storage or for carrying in a pocket or bag, etc. when not in use.

Turning to FIG. 6, a second embodiment of the removable and replaceable cleat apparatus of the invention is shown. Reference numerals are shown that correspond to like reference numerals that designate like elements shown in the other figures. In addition, the first strap 16 is comprised of a pair of independent half-width first strap portions 40 connected to the base assembly 12. Each half-width first strap portion 40 includes a quantity of the first hook-or-loop material 36. The second strap 18 is comprised of a pair of independent half-width second strap portions 42 connected to the base assembly 12. Each half-width second strap portion 42 includes a quantity of the second loop-or-hook material 38. The base assembly 12, the half-width first strap portions 40 of the first strap 16, and the half-width second strap portions 42 of the second strap 18 are comprised of a single, unified, combination, longitudinally elastic base/strap assembly 44.

In using the second embodiment of the invention, one of the half-width first strap portions 40 can be grasped in one hand, and one of the half-width second strap portions 42 can be grasped in the other hand. The grasped half-width first strap portion 40 and the grasped half-width second strap portion 42 can be pulled to a desired degree of tension, and the second loop-or-hook material 38 of the grasped half-width second strap portion 42 is placed on the first hook-or-loop material 36 of the grasped half-width first strap portion 40, whereby the half-width first strap portion 40 is attached to the half-width second strap portion 42. Then, the second of the half-width first strap portions 40 and the second of the half-width second strap portions 42 are grasped by the two hands of the user. When the second half-width first strap portion 40 and the second half-width second strap portion 42 are pulled by the user, they can be pulled in two directions simultaneously, one direction 180 degrees away from each other, and one direction away from the adjacent half-width first strap portion 40 and the adjacent half-width second strap portion 42, respectively. Tension of pulling the half-width first strap portion 40 and the half-width second strap portion 42 away from the adjacent half-width first strap portion 40 and the adjacent half-width second strap portion 42, respectively, causes the longitudinally elastic base assembly 12 to be stretched in a transverse manner. As a result, the cleat units 14 can be positioned out of parallel with each other. In this way, the arrangement of the cleat pattern can be changed by controlling the variations of stretch of the base assembly 12 caused by variations in tension applied to the half-width first strap portions 40 and the half-width second strap portions 42.

The components of the removable and replaceable cleat apparatus of the invention can be made from inexpensive and durable rubber, metal, and plastic materials. More specifically, the single, unified longitudinally elastic base/strap assembly 26 and the single, unified combination longitudinally elastic base/strap assembly 44 can be made from elastic material such as commonly employed in elastic headbands and the like.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved removable and replaceable cleat apparatus that is low in cost, relatively simple in design and operation, and which may advantageously be added to or removed from existing footwear as desired. With the invention, a removable and replaceable cleat apparatus is provided which enables a person to alter a cleat pattern if desired. With the invention, a removable and replaceable cleat apparatus is provided which is adjustable to fit a wide range of footwear sizes. With the invention, a removable and replaceable cleat apparatus is provided which employs straps that have complementary hook-and-loop material. With the invention, a removable and replaceable cleat apparatus is provided which includes a single piece of material that serves to support both cleats and hook-and-loop material used to attach the device to the footwear. With the invention, a removable and replaceable cleat apparatus is provided which can be folded or rolled up into a relatively small-volume form when the device is not in use.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A cleat apparatus, comprising:

a longitudinally elastic base assembly, a plurality of cleat units connected to said base assembly, a first strap connected to a first side of said base assembly, and a second strap connected to a second side of said base assembly, wherein each of said cleat units includes:

a cleat support, a plurality of individual cleats projecting upward from said cleat support and through said base assembly, and cleat locks connected to said cleats distal to said cleat support, whereby said cleat locks secure said cleats to said base assembly.

2. The apparatus of claim 1 wherein said first strap and said second strap are longitudinally elastic.

3. The apparatus of claim 1 wherein said base assembly, said first strap, and said second strap are comprised of a single, unified, combination, longitudinally elastic base/strap assembly.

4. The apparatus of claim 1 wherein:

each cleat support is a metal block that has receiving channels for said cleats, each cleat is a rivet that includes a rivet head and a rivet shank connected to said rivet head, wherein each rivet shank passes through one of said receiving channels and passes through a portion of said base assembly, and each of said cleat locks is in a form of a washer that is fixed to a rivet shank.

5. The apparatus of claim 1 wherein:

said first strap includes a quantity of first hook-or-loop material, and said second strap includes a quantity of complementary second loop-or-hook material.

6. The apparatus of claim 1 wherein said first strap is comprised of a pair of independent half-width first strap portions connected to said base assembly.

7. The apparatus of claim 6 wherein each half-width first strap portion includes a quantity of said first hook-or-loop material.

8. The apparatus of claim 6 wherein said second strap is comprised of a pair of independent half-width second strap portions connected to said base assembly.

9. The apparatus of claim 8 wherein each half-width second strap portions includes a quantity of said second loop-or-hook material.

10. The apparatus of claim 8 wherein said base assembly, said half-width first strap portions of said first strap, and said half-width second strap portions of said second strap are comprised of a single, unified, combination, longitudinally elastic base/strap assembly.

11. A cleat apparatus, comprising:

a longitudinally elastic base assembly, a plurality of cleat units connected to said base assembly, each of said cleat units being oriented in a parallel condition with respect to the others transversely of said longitudinal base assembly when said longitudinally elastic base assembly is in a first unstretched condition, a first strap connected to a first side of said base assembly and including a first fastener portion, and a second strap connected to a second side of said base assembly and including a second fastener portion wherein said first fastener portion is adapted to be removably fastened to said second fastener portion when said base assembly is in a second stretched condition, at least said first strap comprising first and second longitudinally extending sections independently adjustable to one another whereby differing amounts of tension applied to said first and second sections is effective to cause said cleat units to assume a non-parallel orientation with respect to each other in a second stretched condition of said elastic base assembly.

* * * * *

UNITED STATES PATENT AND TRADEMARK OFFICE

CERTIFICATE OF CORRECTION

PATENT NO. : 5,737,856
DATED : Apr. 14, 1998
INVENTOR(S) : Raymond J. Brockmann

It is certified that error appears in the above-identified patent and that said Letters Patent is hereby corrected as shown below:

The title page should be deleted to appear as per attached title page.

Signed and Sealed this

Twenty-first Day of July, 1998

Bruce Lehman

*Attest:*

BRUCE LEHMAN

*Attesting Officer*

*Commissioner of Patents and Trademarks*

United States Patent [19]

Brockmann

[11] Patent Number: 5,737,856

[45] Date of Patent: Apr. 14, 1998

[54] REMOVABLE AND REPLACEABLE CLEAT APPARATUS FOR FOOTWEAR

[76] Inventor: Raymond J. Brockmann, P.O. Box 168, Holbrook, N.Y. 11741

[21] Appl. No.: 734,102

[22] Filed: Oct. 21, 1996

[51] Int. Cl.[6] ..... A43C 15/00

[52] U.S. Cl. ..... 36/62; 36/67 D

[58] Field of Search ..... 36/59 R, 132, 36/67 D, 62, 61

[56] References Cited

U.S. PATENT DOCUMENTS

| | | | |
|---|---|---|---|
| 1,024,981 | 4/1912 | Findlay . | |
| 1,326,687 | 12/1919 | Perry | 36/62 |
| 1,429,259 | 9/1922 | Tagliaferry | 36/62 |
| 2,166,958 | 7/1939 | Lawson . | |
| 2,425,939 | 8/1947 | Howard | 36/62 |
| 2,437,143 | 3/1948 | With | 36/62 |
| 3,914,882 | 10/1975 | Greer | 36/62 |
| 4,702,021 | 10/1987 | Cameron | 36/62 |
| 5,485,687 | 1/1996 | Rohde | 36/62 |
| 5,499,458 | 3/1996 | Krunic | 36/62 X |
| 5,533,277 | 7/1996 | Bell et al. | 36/62 X |

FOREIGN PATENT DOCUMENTS

| | | | |
|---|---|---|---|
| 2039611 | 10/1992 | Canada | 36/62 |
| 816363 | 8/1951 | Germany | 36/62 |

*Primary Examiner*—B. Dayoan

[57] ABSTRACT

A cleat apparatus includes a longitudinally elastic base assembly, a plurality of cleat units connected to the base assembly, a first strap connected to a first side of the base assembly, and a second strap connected to a second side of the base assembly. The first strap and the second strap are longitudinally elastic. The base assembly, the first strap, and the second strap are comprised of a single, unified, combination, longitudinally elastic base/strap assembly. Each of the cleat units includes a cleat support. A plurality of individual cleats project upward from the cleat support and through the base assembly. Cleat locks are connected to the cleats distal to the cleat support, whereby the cleat locks secure the cleats to the base assembly. The first strap includes a quantity of first hook-or-loop material, and the second strap includes a quantity of complementary second loop-or-hook material. In a second embodiment, the first strap is comprised of a pair of independent half-width first strap portions connected to the base assembly. Each half-width first strap portion includes a quantity of the first hook-or-loop material. The second strap is comprised of a pair of independent half-width second strap portions connected to the base assembly. Each half-width second strap portion includes a quantity of the second loop-or-hook material.

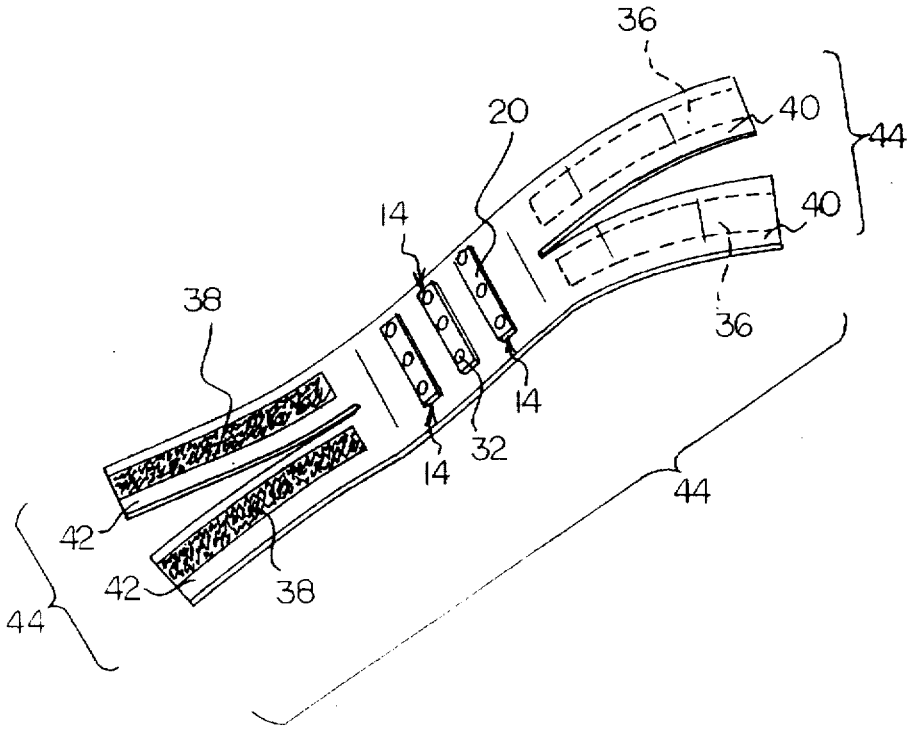

11 Claims, 3 Drawing Sheets